US012268913B2

(12) United States Patent
Fanning et al.

(10) Patent No.: US 12,268,913 B2
(45) **Date of Patent: *Apr. 8, 2025**

(54) EXERCISE WEIGHT

(71) Applicants: Thomas Fanning, Los Angeles, CA (US); Michael Joson, Haverford, PA (US)

(72) Inventors: Thomas Fanning, Los Angeles, CA (US); Michael Joson, Haverford, PA (US)

(73) Assignees: Thomas Fanning, Los Angeles, CA (US); Michael Joson, Haverford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/479,943

(22) Filed: Oct. 3, 2023

(65) Prior Publication Data

US 2024/0024721 A1 Jan. 25, 2024

Related U.S. Application Data

(63) Continuation of application No. 17/315,441, filed on May 10, 2021, now Pat. No. 11,806,565, which is a (Continued)

(51) Int. Cl.
*A63B 21/00* (2006.01)
*A63B 21/06* (2006.01)
(Continued)

(52) U.S. Cl.
CPC ..... *A63B 21/0004* (2013.01); *A63B 21/06* (2013.01); *A63B 21/4039* (2015.10); (Continued)

(58) Field of Classification Search
CPC ..... A63B 21/0004; A63B 21/0601; A63B 21/0602; A63B 21/0603; A63B 21/0604; (Continued)

(56) References Cited

U.S. PATENT DOCUMENTS 4,538,806 A * 9/1985 Wilkerson ..... A63B 21/0603 482/108
6,599,222 B2 * 7/2003 Wince ..... A63B 21/0722 482/106

(Continued)

*Primary Examiner* — Zachary T Moore
(74) *Attorney, Agent, or Firm* — Argus Intellectual Enterprise, LLC; Jordan Sworen; Daniel Enea

(57) ABSTRACT

An exercise weight for strengthening muscles. The exercise weight includes a body having a holding portion that extends between a first distal region and second distal region thereof. The holding portion forms a continuous surface that is curved such that a diameter of the holding portion is narrowest at a proximal point of the holding portion and widest at a first radial edge and an opposing second radial edge. The first and second distal regions are each dome shaped and extend from the first radial edge and the second radial edge, respectively. The holding portion can be received between the inner thighs of a user to add resistance when performing various exercises, such as leg lifts, planks, pull-ups, dips, and the like. In some embodiments, the body includes a weight receiving channel extending therethrough, wherein an elongated weight is positioned within the weight receiving channel.

20 Claims, 9 Drawing Sheets

Related U.S. Application Data continuation of application No. 29/758,426, filed on Nov. 16, 2020, now Pat. No. Des. 954,859.

(60) Provisional application No. 63/026,380, filed on May 18, 2020.

(51) Int. Cl.
*A63B 23/02* (2006.01)
*A63B 23/035* (2006.01)
*A63B 23/04* (2006.01)

(52) U.S. Cl.
CPC .... *A63B 23/0216* (2013.01); *A63B 23/03516* (2013.01); *A63B 23/0482* (2013.01); *A63B 2208/0252* (2013.01); *A63B 2225/02* (2013.01)

(58) Field of Classification Search
CPC ..... A63B 21/0605; A63B 21/0606; A63B 21/0607; A63B 21/072; A63B 21/0724; A63B 21/0726; A63B 21/075; A63B 23/0216; A63B 23/03516; A63B 23/0482
See application file for complete search history.

(56) References Cited

U.S. PATENT DOCUMENTS

| | | | | |
|---|---|---|---|---|
| D708,754 | S * | 7/2014 | Harangvolgyi | D24/211 |
| 8,951,169 | B1 * | 2/2015 | Casper | A63B 21/4035 482/106 |
| 10,434,359 | B2 * | 10/2019 | Feng | A63B 21/0603 |
| 11,806,565 | B2 * | 11/2023 | Fanning | A63B 21/0004 |
| 2014/0005012 | A1 * | 1/2014 | Wang | A63B 21/0726 482/108 |
| 2015/0165267 | A1 * | 6/2015 | Erickson | A63B 23/0222 482/112 |
| 2015/0251043 | A1 * | 9/2015 | Holderbaum | A63B 21/075 482/108 |
| 2018/0078811 | A1 * | 3/2018 | Chen | A63B 23/12 |
| 2019/0247698 | A1 * | 8/2019 | Feng | A63B 21/0603 |
| 2021/0022954 | A1 * | 1/2021 | Jones | A63B 21/075 |

* cited by examiner

EXERCISE WEIGHT

CROSS REFERENCE TO RELATED APPLICATION

This application claims the benefit of U.S. Provisional Application No. 63/026,380 filed on May 18, 2020, U.S. Design patent application Ser. No. 29/758,426 filed on Nov. 16, 2020, and U.S. Nonprovisional application Ser. No. 17/315,441 filed on May 10, 2021; the above identified patent applications are herein incorporated by reference in their entirety.

BACKGROUND OF THE INVENTION

The present invention relates to an exercise weight. More specifically, the present invention relates to an exercise weight that is adapted to be received between the legs of a user and lifted therewith. The exercise weight comprises a body having a continuous surface that is curved so that the right and left side may be positioned between the inner thighs of the user. In this way, the present invention provides an apparatus for exercising the abdominal muscles and other core muscle groups.

Common weight structures fail to allow for ease of exercise of the legs and core of the user, especially when the user is in the supine position. Known weights are advantageous for gripping by hands and manipulated as needed to target general or particular muscle groups. Some users attempt to place these weights behind the knee or lower thigh region to engage core and lower muscles. However, these known weights are not shaped to be coupled to the user during the exercise. Similarly, some users attempt to use place a round shaped weight, such as a medicine ball, between their legs to perform abdominal exercises. However, these weights are not designed to be lifted between a user's legs and can cause discomfort. Moreover, lifting weights in such an unstable manner creates a risk of causing injury.

Many of these weight systems are not designed to target the abdominal and core region or, alternatively, are not designed to solely target the abdominal region. Instead, these known weight systems target various additional muscle groups without focusing on the user's core while an exercise is performed.

Further, some individuals who have hand and wrist injuries often experience impaired movement making it difficult or painful to grasp objects or form a closed fist. These impairments often prevent a person from performing strength exercises because they are unable to grip a dumbbell, resistance band, or other exercise equipment handle. Existing exercise equipment does not permit a user to perform exercises without placing a handle or other type of grasping mechanism in the palm of their hand, requiring them to put strain on injured hand and wrist muscles and ligaments. Therefore, there exists a need for an exercise weight that is designed to focus on the abdominal region that is configured to be held between the inner thighs of a user to add resistance while performing leg lifts while in the supine position.

In light of the devices disclosed in the known art, it is submitted that the present invention substantially diverges in design elements and methods from the known art and consequently it is clear that there is a need in the art for an improvement for an exercise weight. In this regard the instant invention substantially fulfills these needs.

SUMMARY OF THE INVENTION

In view of the foregoing disadvantages inherent in the known types of weights now present in the known art, the present invention provides an exercise weight for placement between the legs of a user for performing various strengthening exercises.

It is an objective of the present invention to provide an embodiment of an exercise weight comprising a body shaped to fit between the legs of the user.

It is another objective of the present invention to provide an embodiment of the exercise weight comprising a body having a holding portion that extends between a first distal region and second distal region, wherein the holding portion is adapted to be received within the thighs of the user.

It is another objective of the present invention to provide an embodiment of the exercise weight wherein the holding portion forms a continuous surface that is curved such that a diameter of the holding portion is narrowest at a proximal point of the holding portion and widest at a first radial edge and an opposing second radial edge.

It is another objective of the present invention to provide an embodiment of the exercise weight wherein the first and the second distal regions are each dome shaped and extend from the first radial edge and a second radial edge, respectively.

It is another objective of the present invention to provide an embodiment of the exercise weight comprising a weight receiving channel extending through the body, wherein a generally elongated weight is positioned within the weight receiving channel and calibrated in weight units.

It is therefore an object of the present invention to provide a new and improved apparatus that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for performing leg lift exercises while holding the exercise weight between the legs of the user. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
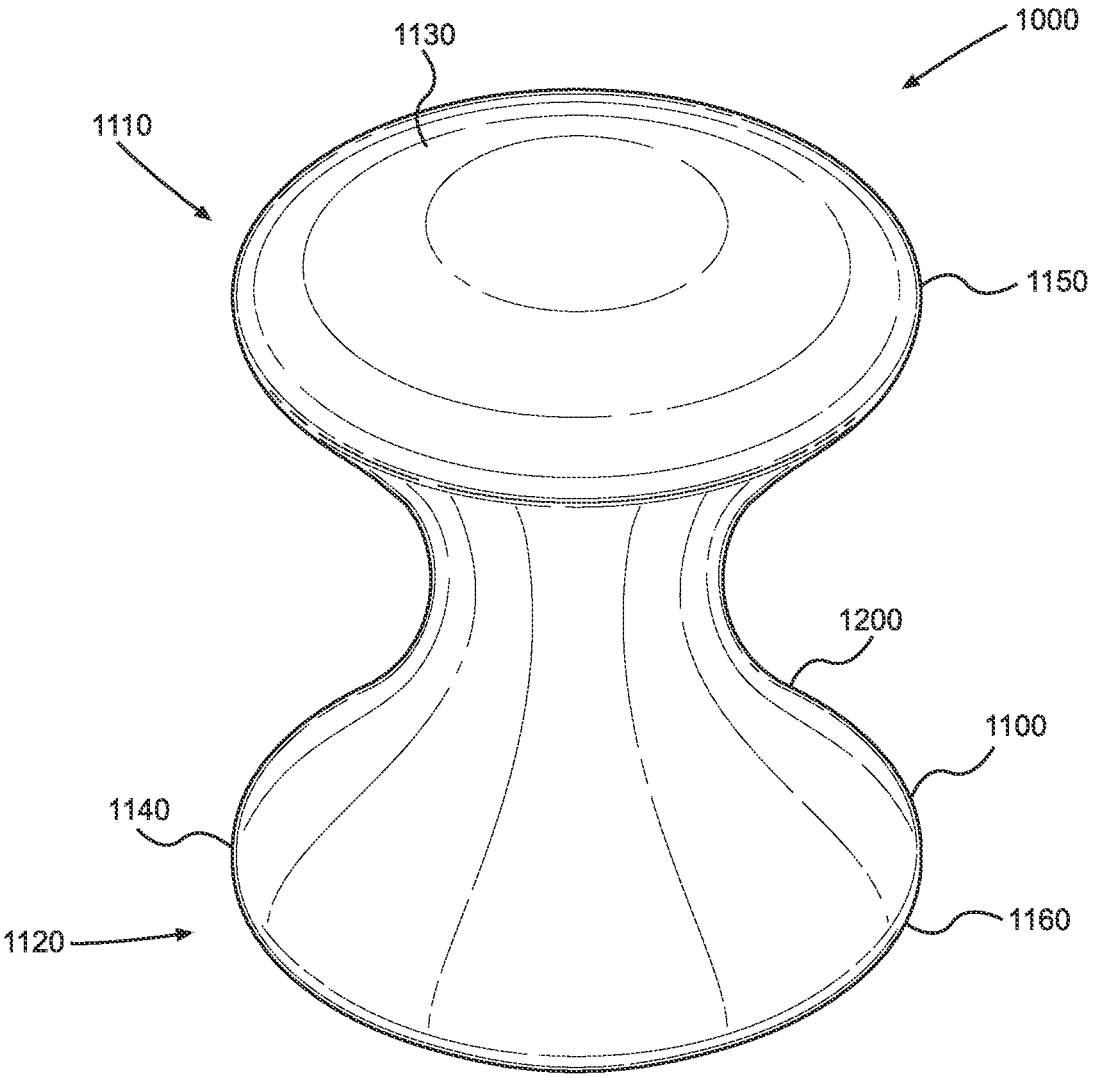
FIG. 1 shows a perspective view of an embodiment of the exercise weight.
Figure 2:
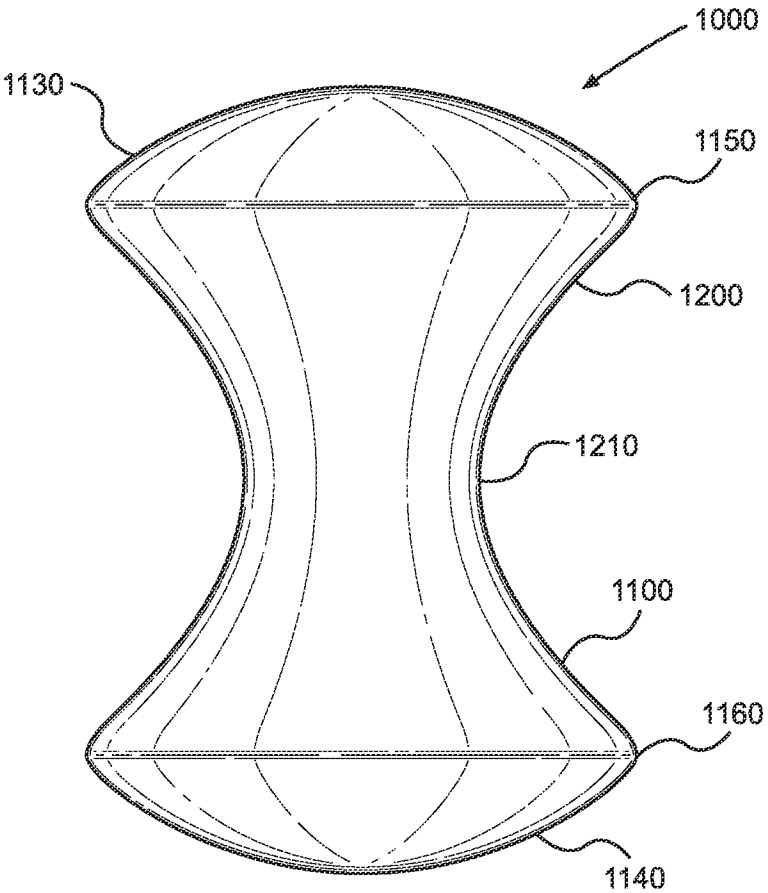
FIG. 2 shows a side view of an embodiment of the exercise weight.

Referring now to FIGS. 1 and 2, there is shown a perspective view and a side view of an embodiment of the exercise weight, respectively. The exercise weight 1000 provides a weight that is sized and adapted to be selectively placed between the legs of a user, such that the user may compress the weight and perform leg lift exercises from a supine, prone, seated, among other positions. In this way, the present invention provides an apparatus for exercising the abdominal muscles and other core muscles.

In the illustrated embodiment, the exercise weight 1000 comprises a body 1100 having a first distal region 1130, an opposing second distal region 1140, and a holding portion 1200 that extends between a first end 1110 and a second end 1120 of the body. The holding portion 1200 is adapted to be received between the thighs of the user by forming a continuous surface that is curved such that a diameter of the holding portion 1200 is narrowest at a proximal point 1210 of the holding portion 1200 and widest at a first radial edge 1150 and a second radial edge 1160. The continuous lateral surface is curved having a depth that extends into the body 1100. The holding portion is defined as the area in which the weight is configured to be held or retained by the user when exercising therewith.

In the illustrated embodiment, the exercise weight 1000 forms a flared cylinder that resembles an apple core shape. In the illustrated embodiment, an exterior perimeter of the body 1100 comprises a circular shaped cross section taken along any horizontal plan thereof. The body 1100 is symmetrical about a horizontal and vertical plane extending through a center point of the body. In this way, the rotational position of the exercise weight 1000 does not materially affect the engagement of the legs of the user.

In some embodiments, the exercise weight 1000 is constructed of a rigid material to provide an optimal stability for performing exercises therewith, such as urethane rubber, neoprene, metal, or the like. In some embodiments, an exterior of the exercise weight 1000 is coated or covered with a rubber material or other soft material to allow the user to more comfortably receive the exercise weight 1000 against their body when performing an exercise. In the illustrated embodiment, the exercise weight 1000 is not deformable under normal usage. In some embodiments, the covered or coated exterior serves as the body 1100 of the exercise weight 1000. The soft exterior prevents damage from occurring if the exercise weight 1000 is inadvertently dropped and provides textural comfort to the user.

Figure 9:
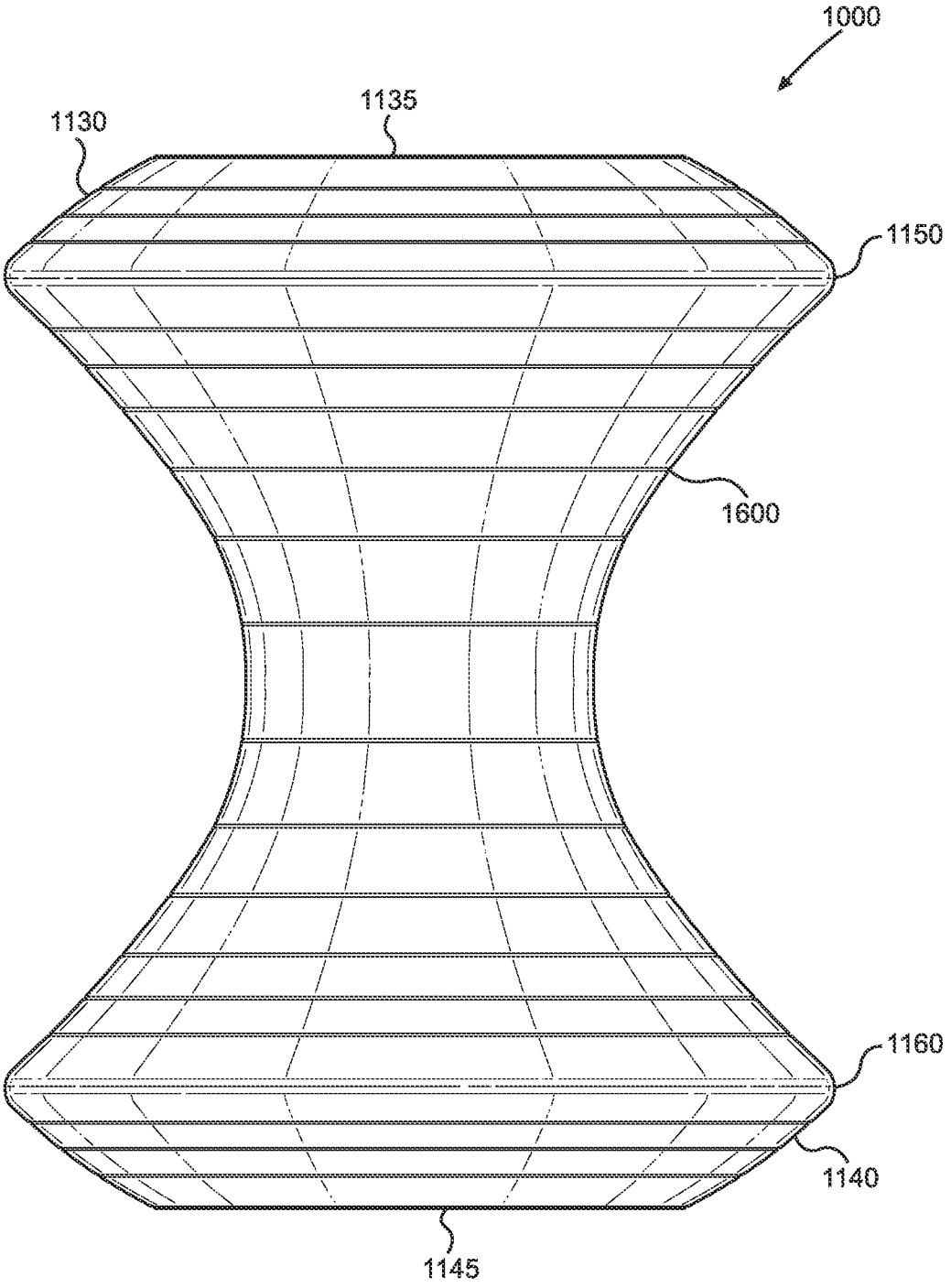
FIG. 9 shows a side view of a second alternate embodiment of the exercise weight.

In some embodiments, the exterior of the exercise weight 1000 comprises texture, such as a plurality of concentric, recessed rings configured to provide better gripping ability for the user (as seen in FIG. 9, 1600).

In the illustrated embodiment, the geometry of the lateral continuous curve of the holding portion 1200 is functionally adapted to form around a portion of the thigh of the user. In the illustrated embodiment, the largest diameter, disposed along the radial edges, is between 7.5 and 8 inches and the smallest diameter, found along the proximal point of the holding portion 1200, is between 3 and 3.5 inches. The ratio between the largest and smallest diameter is between 2.3 and 2.7 units. As used herein, "unit" or "units" are in inches, however the ration holds for other units of measurement. The lateral continuous curve is formed between the radial edges 1150, 1160 and the ratio between the proximal and distal diameters indicate the depth of the curve. The purpose of describing the diameter differences formed by the lateral continuous curve is to demonstrate the depth formed by the exercise weight 1000 so as to secure around the top portion and bottom portion of each thigh of the user when placed therebetween. These are approximate measurements of an embodiment. In other embodiments, a preferred unit range is between +/−30% of the units described in the illustrated embodiment. In other embodiments, a more preferred unit range is between +/−10% of the units described in the illustrated embodiment.

In some embodiments, the lateral continuous curve comprises a concave surface that when viewed from a side elevation view forms an arc imposed on a circle, wherein the circle comprises a radius and a chord length. The exercise weight forms a chord length of approximately 2.72 units. The unit lengths are intended to describe the scale of the holding portion 1200 and the first and second distal regions 1130, 1140. The imposed circle has an approximate radius of 1.48 units and the internal angle between the uppermost and lowermost intersection points of the circumference and the exercise weight 1000 is approximately 143 degrees. The arc length between the uppermost and lowermost of the exercise weight 1000 is 3.69 units. These are approximate unit measurements of an embodiment. In other embodiments, a preferred unit range is between +/−30% of the units described herein. In other embodiments, a more preferred unit range is between +/−10% of the units described herein. The purpose of describing the arc formed by the lateral continuous curve is to demonstrate the depth formed by the exercise weight 1000 so as to secure around the top portion and bottom portion of each thigh of the user when placed therebetween. If the depth is too shallow, the exercise weight 1000 would not be stably received by the user and the user would be unable to successfully perform exercises therewith.

Figure 3:
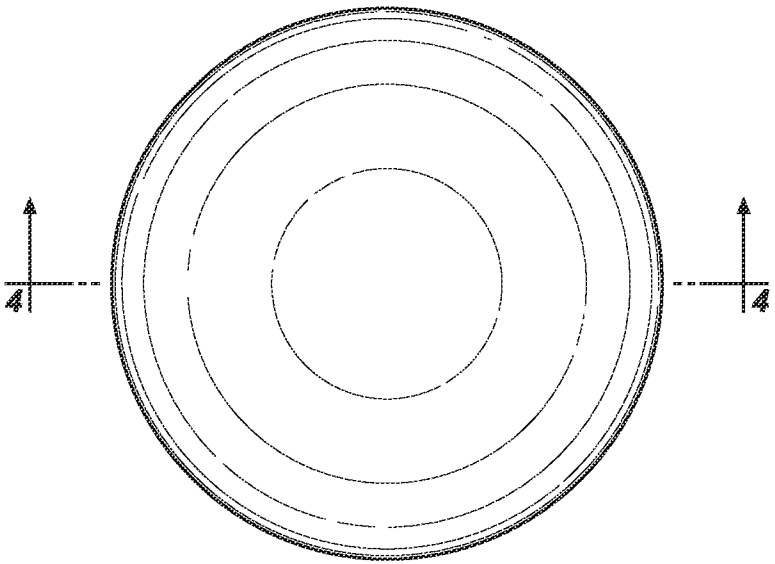
FIG. 3 shows a top plan view of an embodiment of the exercise weight.

Referring now to FIGS. 2 and 3, there is shown the side view and a top plan view of an embodiment of the exercise weight, respectively. In the illustrated embodiment, the first and second distal regions 1130, 1140 are each dome shaped and extend from the first radial edge 1150 and the second radial edge 1160, respectively. The dome shape provides for a round radial edge 1150 to provide comfort to the user, as well as provide additional interior volume for retaining a weighted element in the body 1100.

Figure 4:
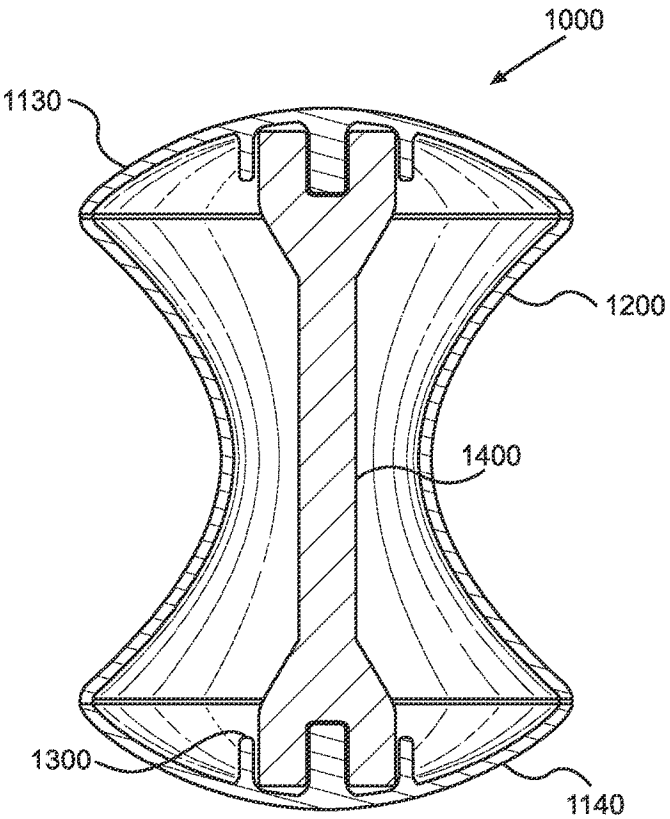
FIG. 4 shows a cross sectional view of an embodiment of the exercise weight taken along line 4-4 of FIG. 3.

Referring now to FIG. 4, there is shown a cross sectional view of an embodiment of the exercise weight taken along line 4-4 of FIG. 1. In the illustrated embodiment, the exercise weight 1000 comprises a weight receiving channel 1300 extending through an interior volume of the body 1100. The ends of the weight receiving channel 1300 are disposed in the distal regions 1130, 1140 of the apparatus 1000 and configured to secure a weight 1400 therein. In the shown embodiments, the weight receiving channel 1300 comprises a pair of recesses 1310 separated by a wall 1320. In the illustrated embodiment, the weight receiving channel 1300 does not extend through the holding portion 1200. In alternate embodiments, the weight receiving channel 1300 extends through the holding portion 1200.

The weight 1400 disposed within the weight receiving channel 1300 is generally elongated so as to extend from the first distal region 1130, through the holding portion 1200, and to the second distal region 1140. The distal ends of the weight 1400 comprise a pair of protrusions 1410 that interlock within the pair of recesses of the weight receiving channel 1300. The wall 1320 of the weight receiving channel 1300 is received by an aligned weight recess 1420 of the weight. The weight 1400 is calibrated in weight units that correlate to the overall weight of the exercise weight and indicates to the user the amount of weight being lifted. For example, a heavier weight 1400 is disposed within the body 1100 for an exercise weight that weighs 20 lbs and a lighter weight is disposed in an exercise weight that weighs 10 lbs. However, regardless of the weight of the exercise weight 1000, the overall dimension and shape of the exercise weight remains unchanged. The difference between a first exercise weight and a second exercise weight weighing different amounts is the weight 1400 disposed therein. In the illustrated embodiment, only a single weight 1400 is receivable by the exercise weight 1000.

Figure 5:
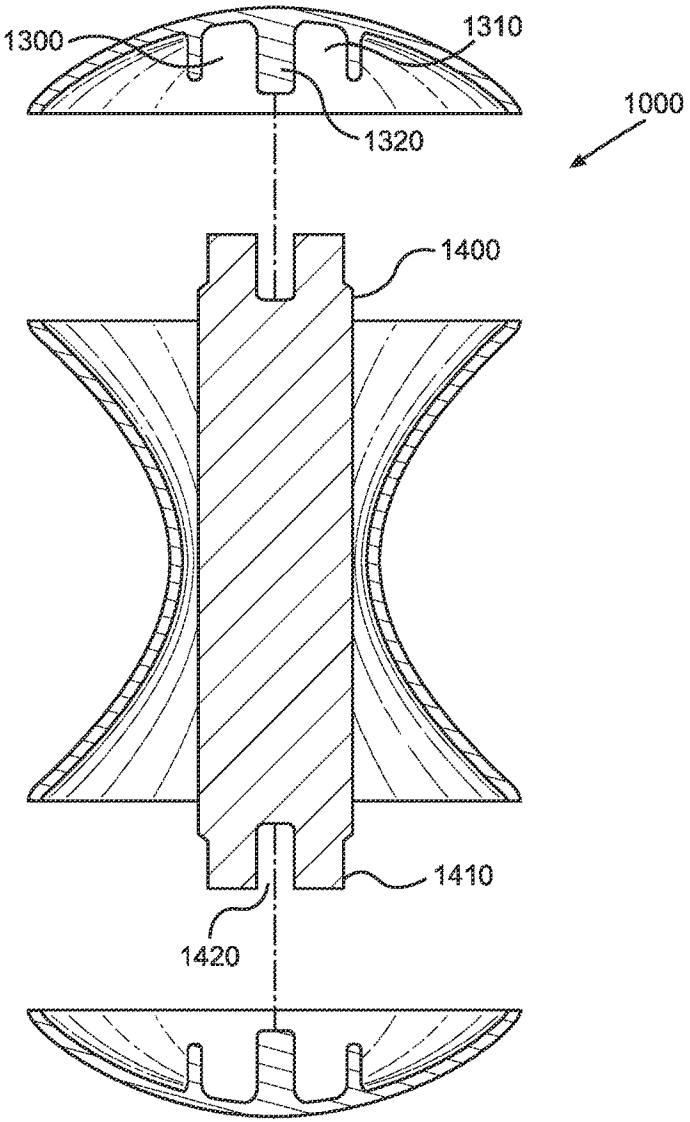
FIG. 5 shows a cross sectional and exploded view of another embodiment of the exercise weight.

Referring now to FIG. 5, there is shown a cross sectional and exploded view of another embodiment of the exercise weight. In some embodiments, the exercise weight 1000 is formed by securing the first and second distal regions 1130, 1140 to the holding portion 1200 along first and second radial edges 1150, 1160, respectively. In some embodiments, at least one distal region is separable from the holding portion so as to interchange the weight 1400 within the weight receiving channel 1300.

Figure 6:
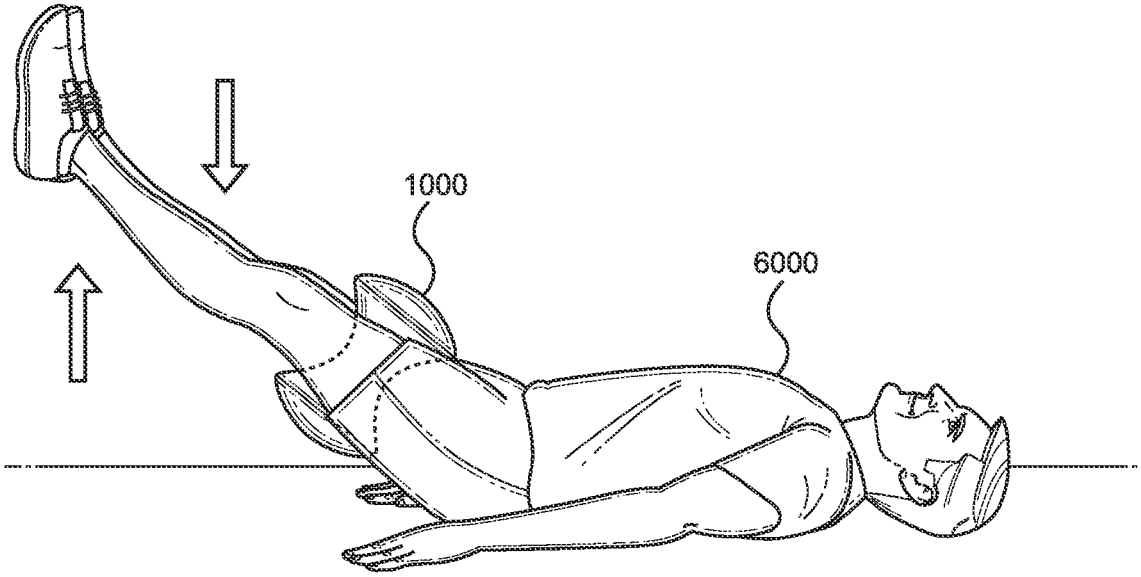
FIG. 6 shows a perspective view of an embodiment of the exercise weight in use.
Figure 7:
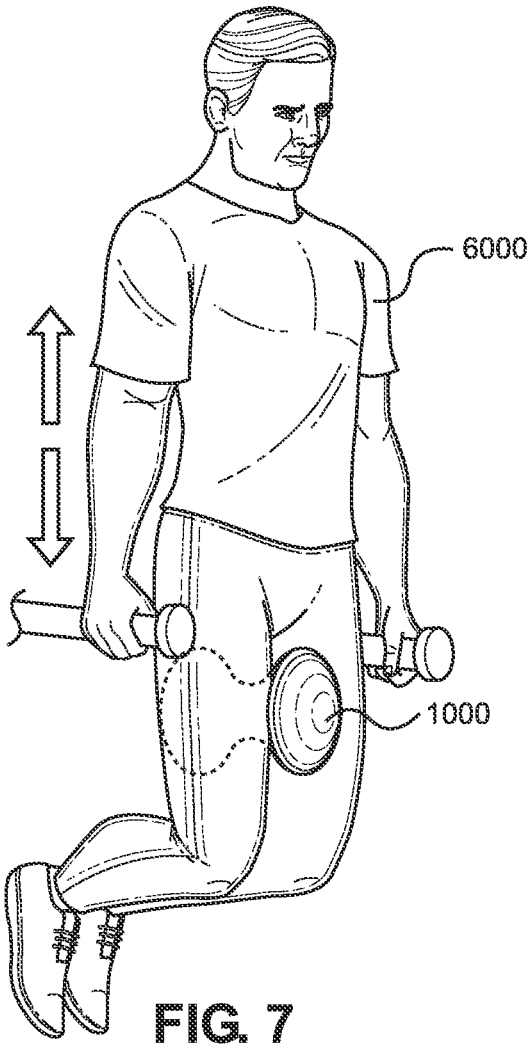
FIG. 7 shows another perspective view of an embodiment of the exercise weight in use.
Figure 8:
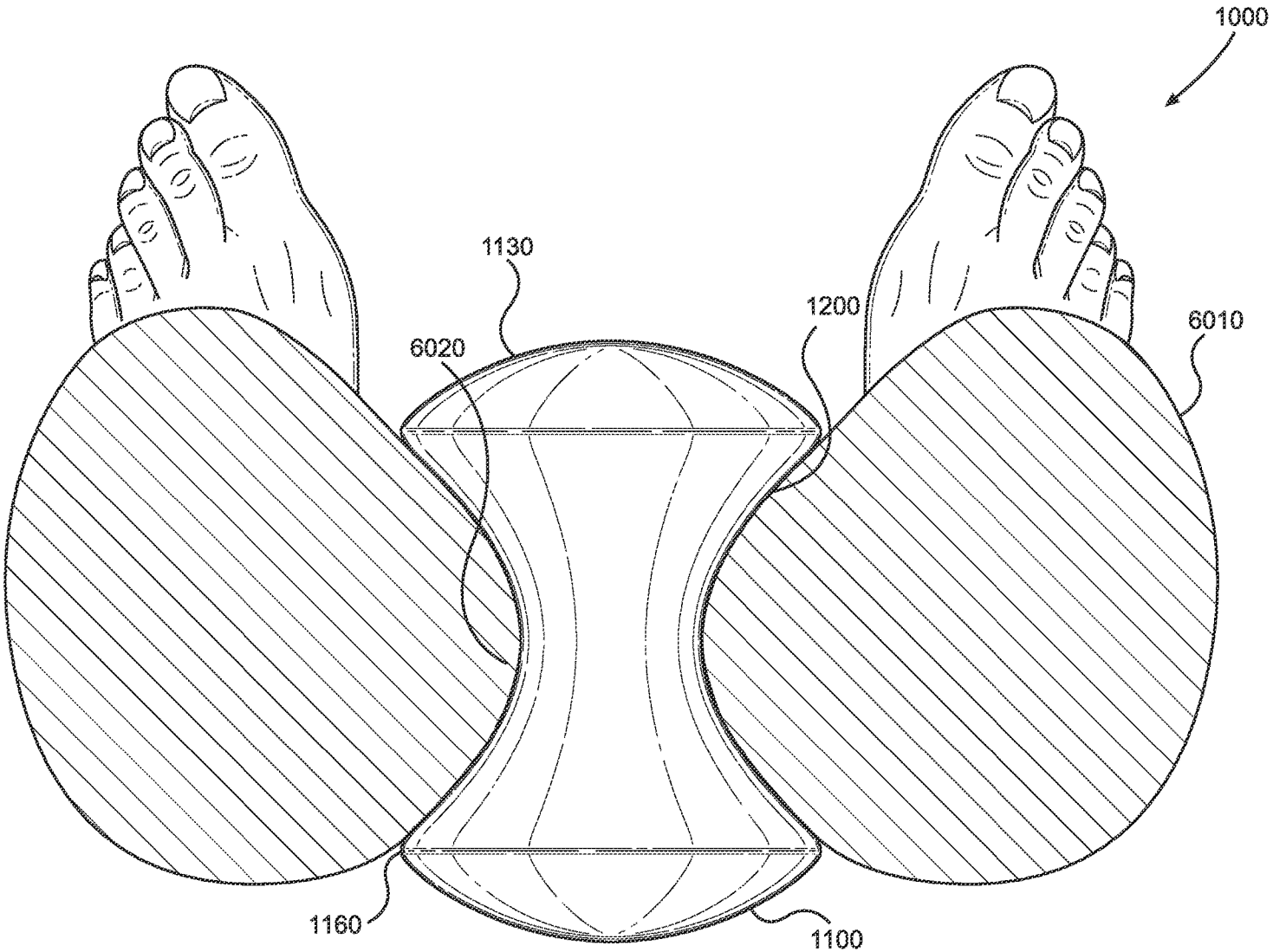
FIG. 8 shows a side view of an embodiment of the exercise weight positioned between a cross sectional view of a user's thighs.

Referring now to FIGS. 6 and 7, there are shown perspective views of an embodiment of the exercise weight in use. In operation, the exercise weight 1000 is positioned between a pair of inner thighs of a user, above the knees. In one embodiment, the surface of the continuous curve of the holding portion is configured to rest flush against a user's thighs (as seen in FIG. 8). In the illustrated embodiment, the exercise weight extends up to 8 inches radially from a longitudinal axis so as to encompass a substantial portion of the received leg of the user. The radial edges are adapted to rest on top of or underneath the thighs of the user. The exercise weight 1000 is adapted to be used simultaneously while the user is in the supine, prone, upright, or seated position and performing body exercises, such as leg lifts, body dips, pullups, among many other exercises.

In one embodiment, a method of exercising a muscle of a user comprises providing an exercise weight including a body having a holding portion that extends between a first distal region and an opposing second distal region, wherein the holding portion forms a continuous surface that is curved such that a diameter of the holding portion is narrowest at a proximal point of the holding portion and widest at a first radial edge and an opposing second radial edge, wherein the first and second distal regions are each dome shaped and extend from the first radial edge and the second radial edge, respectively; positioning the exercise weight between a pair of corresponding thighs of the user, such that the first distal region is positioned over a top of the pair of thighs and the second distal region is positioned on an opposing side of the pair of thighs; moving the body of the user while simultaneously holding the exercise weight between his or her thighs.

In one preferred method of use, the exercise weight is held between the thighs of a user during an 8" to 12" leg lift exercise in the supine position to directly target and strengthen the core muscles of the user by adding weight resistance to the exercise. In other uses, the exercise weight is held between the thighs of the user in an exact same position as the leg lift is performed, to perform other exercises, such as dips, pull ups, planks, and the like, to add weight resistance.

Referring now to FIG. 8, there is shown a side view of an embodiment of the exercise weight positioned between a cross sectional view of a user's thighs. The exercise weight 1000 is ergonomically designed to be held between the thighs 6010 of the user, above the knee. In the shown method of use, the surface of the continuous curve formed between of the two radial edges 1160 of the holding portion 1200 is configured to rest flush against the inner surfaces 6020 of the thighs of the user, wherein the distal regions 1130 of the body 1100 of the exercise weight 1000 are adapted to rest on top of or underneath the thighs of the user. The continuous curved surface of the holding region 1200 allows user to comfortably receive the exercise weight between his or her thighs and the dome shape of the distal regions prevents any interference thereof with the user while performing an exercise.

Referring now to FIG. 9, there is shown a side view of a second alternate embodiment of the exercise weight. In the illustrated embodiment, the first and second distal regions 1130, 1140 comprise a circular cross-sectional shape and extend from the first radial edge 1150 and the second radial edge 1160, respectively. However, in the illustrated embodiment, the uppermost surface 1135 of the first distal region 1130 and the lowermost surface 1145 of the second distal region 1140 are flat. In this way, the flat surfaces 1135, 1145 allow the exercise weight 1000 to rest upright on a ground surface, without additional supports.

Figure 10:
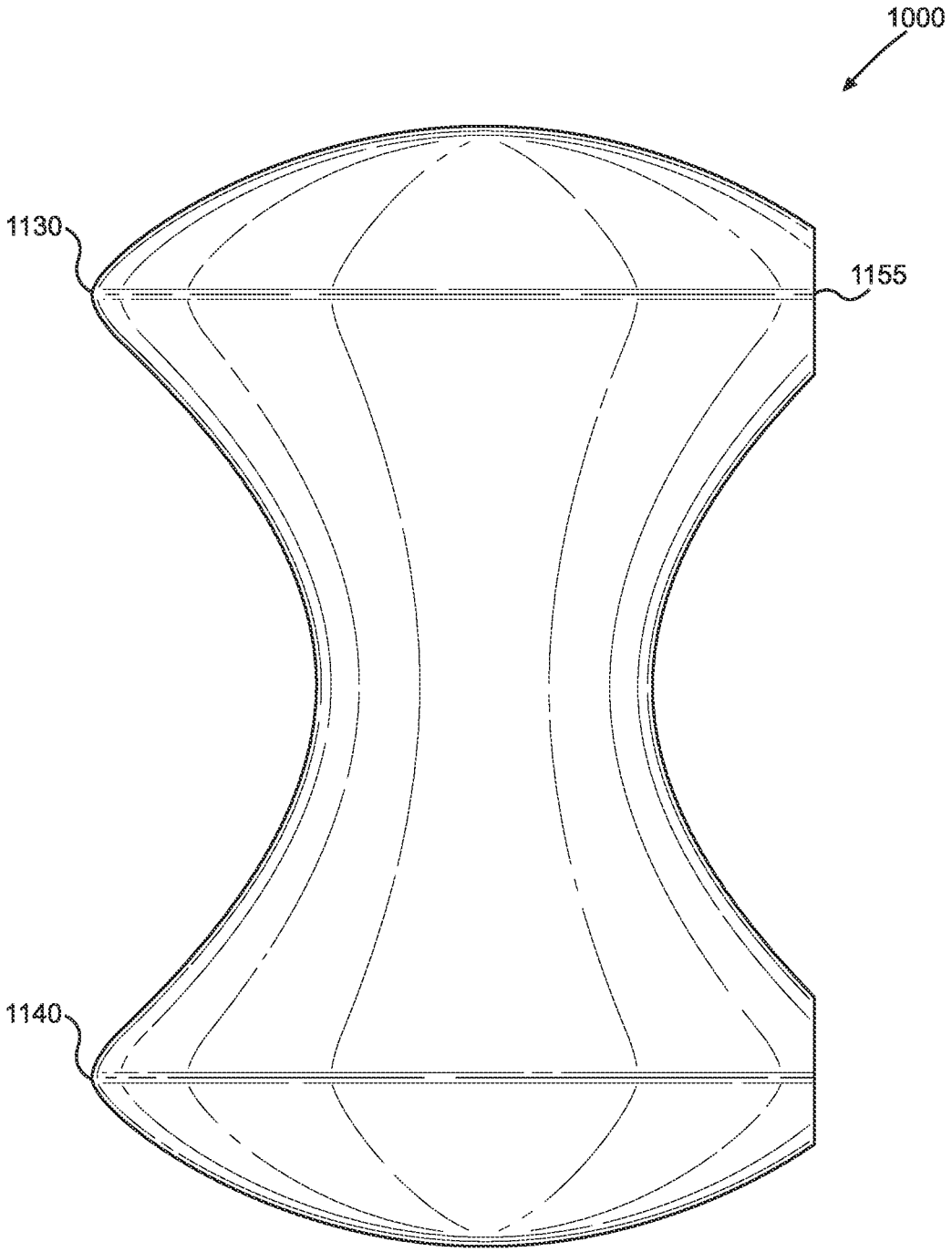
FIG. 10 shows a side view of a third alternate embodiment of the exercise weight.
Figure 11:
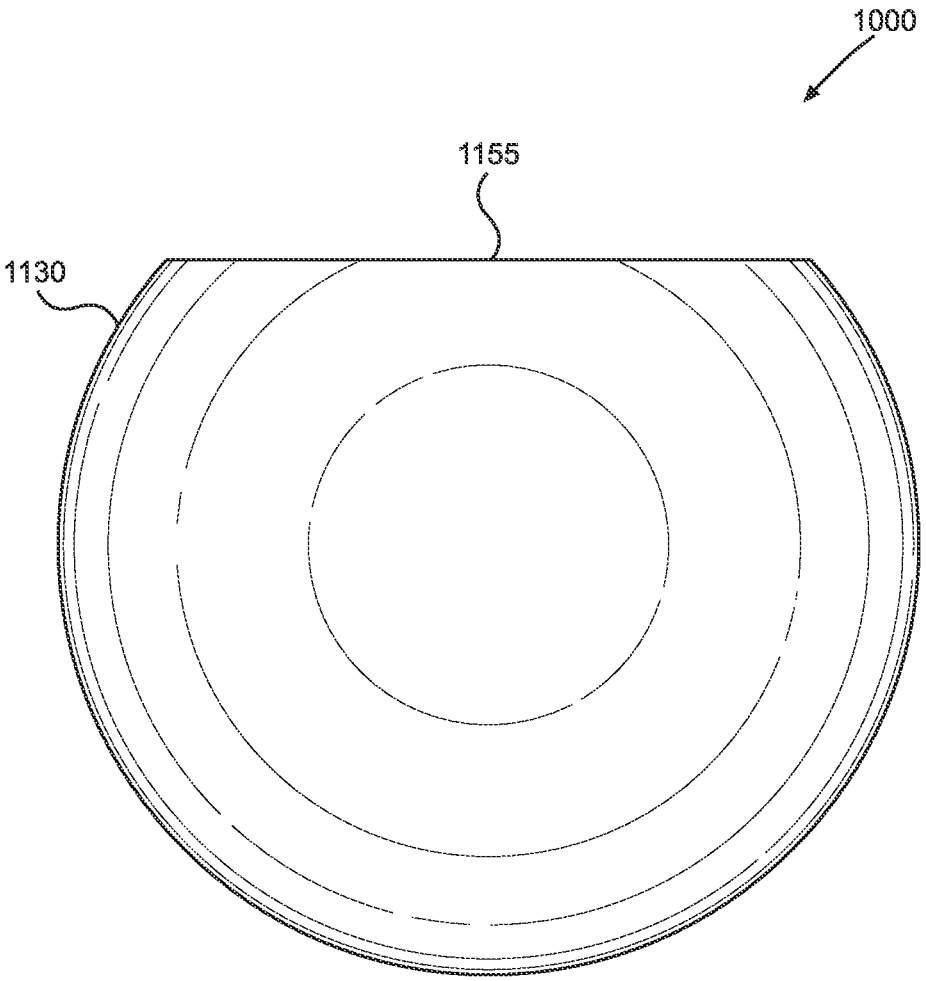
FIG. 11 shows a top plan view of a third alternate embodiment of the exercise weight.

Referring now to FIGS. 10 and 11, there is shown a side view and a top plan view of a third alternate embodiment of the exercise weight, respectively. In some embodiments, the first and second distal regions 1130, 1140 each comprise a flat lateral exterior edge 1155. The flat lateral exterior edge 1555 prevents the exercise weight 1000 from rolling when the lateral exterior edge 1555 is placed on a ground surface. The flat lateral exterior edge of the first distal region is aligned with the flat lateral exterior edge of the second distal region. In this way, the flat lateral exterior edges provide a flat surface to rest the weight in a horizontal orientation. In the shown embodiment, a length of the flat lateral exterior edges along the first and second distal regions 1130, 1140 (when viewed from a top plan view) is less than the diameter of the first and second distal regions 1130, 1140. In this way, the area of the weight present is greater than the area of the missing portion should the shape of the weight be completed and symmetrical. In some embodiments, a plurality of lateral exterior edges of the first and second distal regions are flat to provide multiple surface areas that prevent the exercise weight from rolling on another surface.

In some embodiments, the body does not comprise a flat lateral edge and instead includes a protuberance that prevents or halts the rotation of the exercise weight when placed horizontally on a surface.

Figure 12:
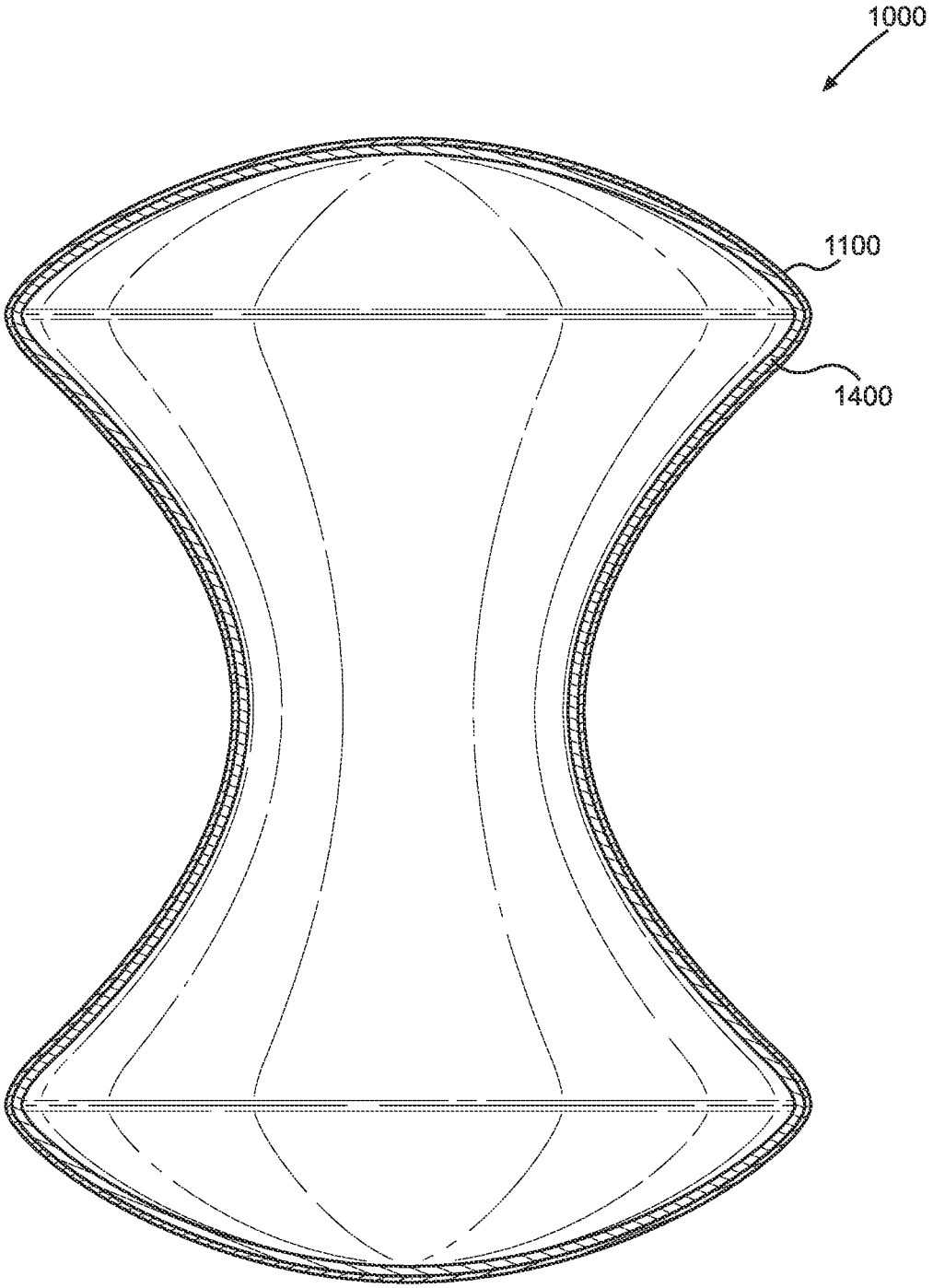
FIG. 12 shows a cutaway view of a fourth alternate embodiment of the exercise weight.

Referring now to FIG. 12, there is shown a cutaway view of a fourth alternate embodiment of the exercise weight. In the illustrated embodiment, the weight 1400 comprises a substantially same shape as the body 1100 of the exercise weight 1000. In the illustrated embodiment, the body 1100 seals the weight therein, such that the weight 1400 is not removable therefrom. The body 1100 provides an exterior shell to the weight 1400 disposed therein. In the illustrated embodiment, the weight 1400 is hollow and composed of a metal material.

In some embodiments, the present invention comprises a plurality of exercise weights each having a different weight amount, but having a same shape and size of the bodies. For example, a first exercise weight comprises a body having a same shape and dimension of a body of a second exercise weight. However, the weight disposed within an interior of the body of the second exercise weight is heavier than the weight disposed within the interior of the body of the first exercise weight. To achieve different weight amounts while maintaining the size and shape of the bodies, the sidewall of the weight of the second exercise weight is thicker than the sidewall of the weight of the first exercise weight. In this way, an interior volume of the second exercise weight is smaller than an interior volume of the first exercise weight. In some embodiments, the thickness of a wall of the body also becomes thinner to accommodate a heavier weight disposed therein. Therefore, in some embodiments, multiple exercise weights appear identical in shape and size, but have different weight amounts, wherein the weight amounts are configured to be displayed on an exterior of the body to allow a user to identify the weight amount of each exercise weight. The benefit of maintaining a single overall shape and dimension amongst a plurality of exercise weights having different weight amounts, is that a user will be able to easily grip and manipulate the exercise weights without difficulty of each exercise weight being too large or too small to fit between his or her legs.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An exercise weight for positioning between a pair of thighs of a user, comprising:

a body having a holding portion that extends between a first distal region and an opposing second distal region;

wherein the holding portion forms a continuous surface that is curved such that a diameter of the holding portion is narrowest at a proximal point of the holding portion and widest at a first radial edge and an opposing second radial edge;

wherein the holding portion is adapted to be received between a pair of thighs of the user;

wherein the body comprises a weight that extends from the first distal region to the second distal region;

wherein the first radial edge and the second radial edge form the largest diameter of the body.

2. The exercise weight of claim 1, wherein the body resembles an apple core shape.

3. The exercise weight of claim 1, wherein the body comprises rotational symmetry about a longitudinal axis, wherein the longitudinal axis extends between the first and second distal regions.

4. The exercise weight of claim 3, wherein a weight receiving channel extends along the longitudinal axis and configured to receive the weight therein.

5. The exercise weight of claim 4, wherein the weight is an elongated weight that extends from the first distal region to the second distal region.

6. The exercise weight of claim 3, further comprising horizontal symmetry about a horizontal axis of the proximal point.

7. The exercise weight of claim 1, further comprising a weight receiving channel extending through the body and an elongated weight positioned within the weight receiving channel.

8. The exercise weight of claim 1, wherein the weight comprises a substantially same shape as the body.

9. The exercise weight of claim 1, where the first radial edge and the second radial edge have a diameter at least 2.3 times larger than the diameter of the proximal point of the holding portion.

10. The exercise weight of claim 1, wherein the exercise weight extends at least 7 inches radially from a longitudinal axis.

11. The exercise weight of claim 1, wherein the first and second distal regions are each dome shaped and extend from the first radial edge and the second radial edge, respectively.

12. The exercise weight of claim 1, wherein an uppermost surface of the first distal region is flat.

13. The exercise weight of claim 1, wherein a lateral exterior edge of the first distal region and the second distal region are flat to prevent the exercise weight from rolling.

14. The exercise weight of claim 1, wherein the body comprises a plurality of concentric, recessed rings disposed therearound.

15. The exercise weight of claim 1, wherein the weight extends into both the first distal region and second distal region simultaneously.

16. A method of exercising a muscle of a user, comprising:

providing an exercise weight comprising a body having a holding portion that extends between a first distal region and an opposing second distal region; wherein the holding portion forms a continuous surface that is curved such that a diameter of the holding portion is narrowest at a proximal point of the holding portion and widest at a first radial edge and an opposing second radial edge; wherein the holding portion is adapted to be received between a pair of thighs of the user;

wherein the body comprises a weight that extends from the first distal region to the second distal region; wherein the first radial edge and the second radial edge form the largest diameter of the body;

positioning the exercise weight between a pair of corresponding thighs of the user, such that the first distal region is positioned over a top of the pair of thighs and the second distal region is positioned on an opposing side of the pair of thighs;

moving the pair of thighs while simultaneously holding the exercise weight therebetween.

17. The method of claim 16, further comprising lifting the legs of the user while the user is in a supine position.

18. The method of claim 16, wherein the exercise weight is positioned above the knees of the user.

19. The method of claim 16, wherein an entire surface of the continuous curve formed between of the two radial edges of the holding portion is configured to rest flush against inner surfaces of the thighs of the user.

20. An exercise weight for positioning between a pair of thighs of a user, comprising:

a body having a holding portion that extends between a first distal region and an opposing second distal region;

wherein the holding portion forms a continuous surface that is curved such that a diameter of the holding portion is narrowest at a proximal point of the holding portion and widest at a first radial edge and an opposing second radial edge;

a first and second flat surface extends from the first and second distal regions to the holder position, respectively;

wherein the flat surface is adapted to support the exercise weight in a horizontal orientation on a horizontal surface;

wherein the holding portion is adapted to be received between a pair of thighs of the user;

wherein the body comprises a weight that extends from the first distal region to the second distal region;

wherein the first radial edge and the second radial edge form the largest diameter of the body.

* * * * *